US008753027B2

(12) United States Patent
Ballot

(10) Patent No.: US 8,753,027 B2
(45) Date of Patent: Jun. 17, 2014

(54) LIQUID APPLICATOR DEVICE

(75) Inventor: Stephan M. Ballot, Barrington Hills, IL (US)

(73) Assignee: Flocon, Inc., Cary, IL (US)

( * ) Notice: Subject to any disclaimer, the term of this patent is extended or adjusted under 35 U.S.C. 154(b) by 520 days.

(21) Appl. No.: 12/804,057

(22) Filed: Jul. 13, 2010

(65) Prior Publication Data

US 2011/0013966 A1 Jan. 20, 2011

Related U.S. Application Data

(60) Provisional application No. 61/270,968, filed on Jul. 14, 2009.

(51) Int. Cl.
*B43K 5/00* (2006.01)

(52) U.S. Cl.
USPC ..... 401/206; 401/205

(58) Field of Classification Search
USPC ..... 401/205, 206, 261, 263
See application file for complete search history.

(56) References Cited

U.S. PATENT DOCUMENTS

| | | | | |
|---|---|---|---|---|
| 1,857,467 | A | | 5/1932 | Marsh |
| 2,024,413 | A | | 12/1935 | Witt |
| 2,104,638 | A | | 1/1938 | Cuthbert |
| 2,210,662 | A | | 8/1940 | Garvey |
| 2,330,053 | A | | 9/1943 | Herb |
| 2,611,916 | A | | 9/1952 | Prokop et al. |
| 2,716,250 | A | | 8/1955 | Deakers |
| 3,468,611 | A | | 9/1969 | Ward |
| 3,481,678 | A | * | 12/1969 | Schwartzman ..... 401/206 |
| 3,484,027 | A | | 12/1969 | Micallef |
| 4,569,612 | A | | 2/1986 | Schwartzman et al. |
| 4,685,820 | A | | 8/1987 | Kremer et al. |
| 4,761,090 | A | | 8/1988 | Goh |
| 4,792,252 | A | | 12/1988 | Kremer et al. |
| 4,812,071 | A | | 3/1989 | Batra et al. |
| 4,848,947 | A | | 7/1989 | Kremer et al. |
| 4,913,175 | A | | 4/1990 | Yokosuka et al. |
| 4,976,564 | A | | 12/1990 | Fukuoka et al. |
| 4,984,923 | A | | 1/1991 | Ota |
| 4,993,859 | A | | 2/1991 | Assad et al. |
| 5,568,990 | A | * | 10/1996 | McAuley ..... 401/206 |
| 5,899,624 | A | | 5/1999 | Thompson |

(Continued)

FOREIGN PATENT DOCUMENTS

| | | |
|---|---|---|
| DE | 20 2006 015 711 U1 | 2/2007 |
| EP | 0 141 126 A1 | 5/1985 |
| FR | 995150 | 6/1949 |
| NL | 1016153 | 3/2002 |

*Primary Examiner* — David Walczak
(74) *Attorney, Agent, or Firm* — Frijouf, Rust & Pyle P.A

(57) ABSTRACT

A liquid applicator device for dispensing an applicator liquid from an applicator liquid container comprising a closure for sealing with the applicator liquid container. A sealing surface is defined in the closure and a valve is disposed within the closure. A spring is located within the closure between a spring retaining step defined in the closure and the valve for biasing the valve into sealing engagement with the sealing surface of the closure for inhibiting the flow of the applicator liquid from the applicator liquid container. A passageway defined in the closure for slidably receiving an applicator tip for engaging with the valve to enable a depression of the applicator tip to displace the valve from the sealing surface of the closure to flow applicator liquid from the applicator liquid container to the applicator tip.

12 Claims, 11 Drawing Sheets

(56) References Cited

U.S. PATENT DOCUMENTS

| | | | | |
|---|---|---|---|---|
| 5,899,627 | A * | 5/1999 | Dobrovolny | 403/391 |
| 6,010,263 | A | 1/2000 | White et al. | |
| 6,513,681 | B2 | 2/2003 | Gross et al. | |
| 6,634,821 | B2 | 10/2003 | Gueret | |
| 6,641,320 | B1 | 11/2003 | Ballot et al. | |
| 6,773,193 | B2 | 8/2004 | Delage | |
| 6,817,801 | B1 | 11/2004 | Colburn et al. | |
| 6,817,802 | B2 | 11/2004 | Nishitani et al. | |
| 6,883,995 | B1 | 4/2005 | Gueret | |
| 6,935,536 | B2 | 8/2005 | Tardif | |
| 6,945,722 | B2 | 9/2005 | Colburn et al. | |
| 7,101,105 | B2 | 9/2006 | Reggiani | |
| 7,114,871 | B2 | 10/2006 | Thiebaut | |
| 7,563,046 | B2 | 7/2009 | Patel | |
| 2002/0021933 | A1 | 2/2002 | Knieriemen | |
| 2005/0141951 | A1 | 6/2005 | Gueret | |
| 2006/0083577 | A1 | 4/2006 | Gueret | |
| 2009/0103968 | A1 | 4/2009 | Ballot | |

* cited by examiner

PRIOR ART

LIQUID APPLICATOR DEVICE

CROSS-REFERENCE TO RELATED APPLICATIONS

This application claims benefit of U.S. Patent Provisional application No. 61/270,968 filed Jul. 14, 2009. All subject matter set forth in provisional application No. 61/270,968 filed Jul. 14, 2009 is hereby incorporated by reference into the present application as if fully set forth herein.

BACKGROUND OF THE INVENTION

1. Field of the Invention

This invention relates to the dispensing of liquids and more particularly, this invention relates to an improved liquid applicator device for marking, writing or dispensing a liquid on a surface.

2. Background of the Invention

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improve the design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stern is mounted for rotation in the boss member. The valve stern has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as a paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member which comprises: a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube ends engage ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening which may be removably closed by a closure element. The second compartment may form a housing for an applicator which is insoluble with respect to the product. The applicator may rest against an elastically compressible porous member that may be in flow communication with the supply orifice.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a close position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

U.S. Pat. No. 6,945,722 to Colburn et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

U.S. Pat. No. 6,641,320 disclosed an improvement to U.S. Pat. No. 4,685,820 to Kremer et al. comprising an applicator tip having a recess and a generally toroidal retaining ring disposed in the recess of the applicator tip. The recess cooperates with the retaining ring for preventing removal of the applicator tip from the liquid applicator device.

It is an object of the present invention is to improve upon U.S. Pat. No. 4,685,820 to Kremer et al. and U.S. Pat. No. 4,792,252 to Kremer et al. and U.S. Pat. No. 6,641,320 to provide an improved liquid applicator device that is simpler in design and more economical to manufacturer.

Another object of the present invention is to provide an improved liquid applicator device that has a reduced number of parts.

Another object of the present invention is to provide an improved liquid applicator device that has a reduced number of parts.

Another object of the present invention is to provide an improved liquid applicator device that requires a reduced number of stages for assembly.

Another object of the present invention is to provide an improved liquid applicator device that may be used with existing containers.

Another object of the present invention is to provide an improved liquid applicator device that may be used with existing applicator tips.

Another object of the present invention is to provide an improved liquid applicator device that may be used with liquids previously unusable in the liquid applicator devices of the prior art.

The foregoing has outlined some of the more pertinent objects of the present invention. These objects should be construed as being merely illustrative of some of the more prominent features and applications of the invention. Many other beneficial results can be obtained by modifying the invention with in the scope of the invention. Accordingly other objects in a full understanding of the invention may be had by referring to the summary of the invention and the detailed description describing the preferred embodiment of the invention.

SUMMARY OF THE INVENTION

The present invention is defined by the appended claims with the specific embodiments shown in the attached drawings. For the purpose of summarizing the invention, the invention is incorporated into a liquid applicator device for dispensing an applicator liquid from an applicator liquid container comprising a closure for sealing with the applicator liquid container. A sealing surface is defined in the closure and a valve is disposed within the closure. A spring is located within the closure between a spring retaining step defined in the closure and the valve for biasing the valve into sealing engagement with the sealing surface of the closure for inhibiting the flow of the applicator liquid from the applicator liquid container. A passageway is defined in the closure for slidably receiving an applicator tip for engaging with the valve to enable a depression of the applicator tip to displace the valve from the sealing surface of the closure to flow applicator liquid from the applicator liquid container to the applicator tip.

In one embodiment of the invention, the sealing surface is unitary with the closure. Preferably, the sealing surface is an annular sealing surface.

In another embodiment of the invention, the spring retaining step is unitary with the closure. Preferably, the spring retaining step is an inwardly extending spring retaining step unitary with the closure.

In one example of the invention, the spring is a metallic spring. In an alternate example of the invention, the spring is a plastic spring.

In one specific embodiment of the invention, the spring is affixed to the valve. In one variation, the spring is unitary with the valve.

In another specific embodiment of the invention, the spring is affixed to the valve. In one variation of this invention, the spring is unitary with the valve.

In still another specific embodiment of the invention, the applicator tip is affixed to the valve. In one variation of this invention, the applicator tip is unitary with the valve.

In still a further specific embodiment of the invention, the applicator tip is affixed to the valve and affixed to the plastic spring. In one variation of this invention, the applicator tip is unitary with the valve and unitary with the plastic spring.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments maybe modifying for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
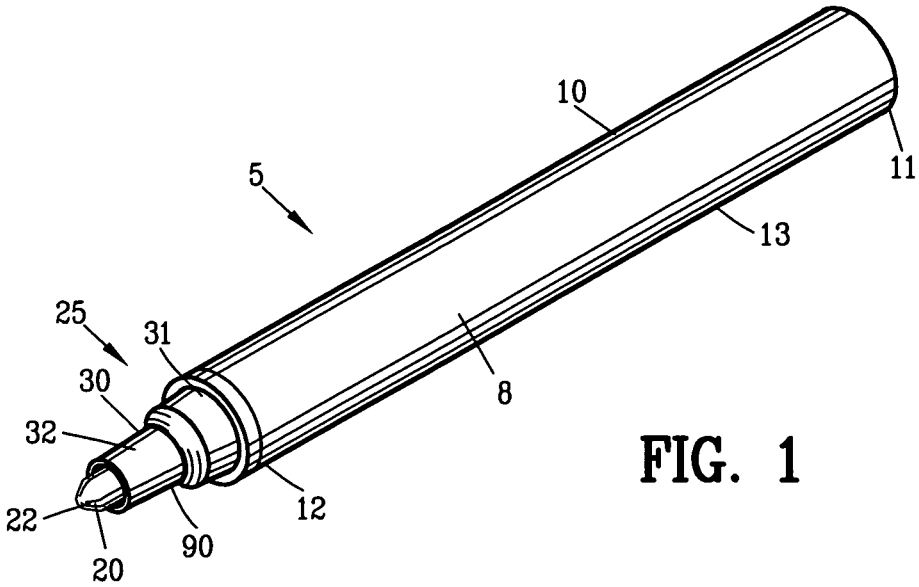
FIG. 1 is an isometric view of a liquid applicator device of the present invention.

FIG. 1 illustrates a liquid applicator device 5 for dispensing an applicator liquid 8 from a container 10. The liquid applicator device 5 comprises an applicator tip 20 for dispensing the applicator liquid 8 from the container 10 onto the surface (not shown) by a dispensing mechanism 25. As will be described in greater detail hereinafter, the applicator tip 20 is used to dispense the applicator liquid 8 from the container 10 onto the surface upon the depression of the applicator tip 20 by the applicator surface. Preferably, a protective overcap (not shown) covers the applicator tip 20 for preventing accidental dispensing of the applicator liquid 8.

Figure 2:
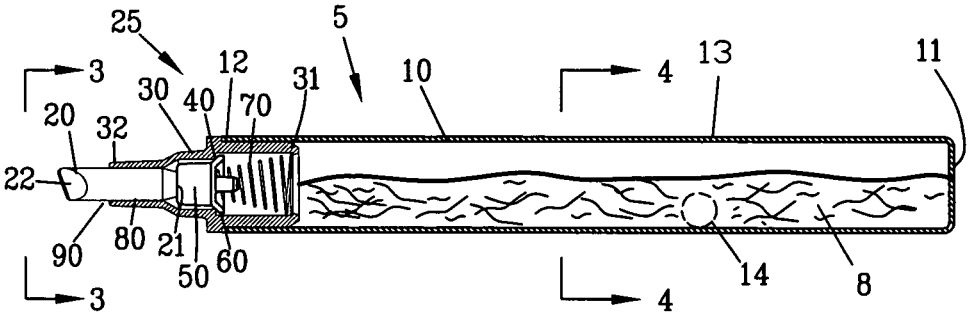
FIG. 2 is a sectional view of the liquid applicator device of FIG. 1.
Figure 3:
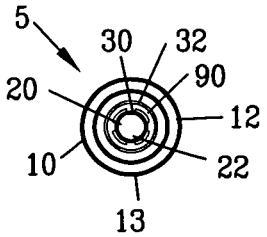
FIG. 3 is a view along line 3-3 in FIG. 2.
Figure 4:
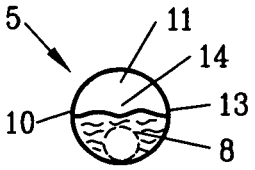
FIG. 4 is a sectional view along line 4-4 in FIG. 2.

FIGS. 2-4 are various views of the liquid applicator device 5 of FIG. 1. The container 10 is preferably formed in a cylindrical shape having a closed end 11, an open end 12 and a cylindrical sidewall 13. The open end 12 is adapted to introduce a quantity of the applicator liquid 8 into the container 10. The applicator liquid 8 may be a marking liquid, a lubricating liquid or any other type of liquid suitable for being dispensed by the applicator tip 20.

When the liquid applicator device 5 is used to apply a marking liquid 8, the marking liquid 8 may be formed of opaque particles suspended in a carrier material as should be well known in the art. In the event that a liquid suspension is used for the applicator liquid 8, the liquid applicator device 5 will preferably include an agitator 14 shown as a ball or a metal slug disposed within the liquid container 10. The purpose of the agitator 14 is to disburse the suspended particles of the applicator liquid 8 throughout the carrier fluid in the event that the suspended particles have become precipitated or settled from the carrier through non-use over a period of time. A preferable material for the agitator 14 is a metallic material selected to minimize any chemical reaction with the applicator liquid 8. The agitator 14 is preferably of a diameter sufficiently smaller than the inside diameter of the container 10 and of a specific gravity significantly greater than the applicator liquid 8 whereby shaking of the container 10 will readily move the agitator 14 to effect the dispersion of the suspended particles throughout the carrier fluid to improve the performance of the liquid applicator device 5.

The applicator tip 20 is a generally cylindrically shaped member extending from an inner end 21 to an outer end 22. The applicator tip 20 may formed from a felt fiber or a brush construction. The applicator tip 20 may be rigid or flexible. In this example of the invention, the applicator tip 20 is formed of a highly compacted fibrous material such as polyester or other similar material having analogous properties sufficient to hold the original shape when moistened with the applicator liquid 8 but adequate to pass the applicator liquid 8 from the inner end 21 to the outer end of the applicator tip 20 by capillary action. It should be appreciated by those skilled in the art that the applicator tip 20 may be formed other various other types of materials.

Figure 5:
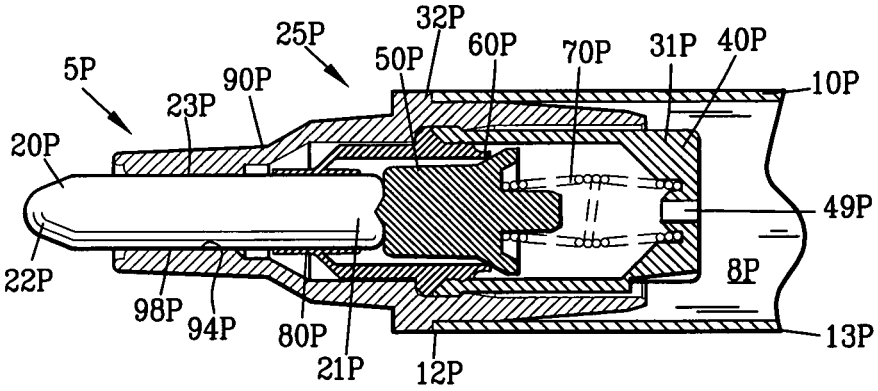
FIG. 5 PRIOR ART
FIG. 5 is an enlarged view of a portion of FIG. 2 illustrating a prior art liquid applicator device in a closed position.

FIG. 5 is an enlarged sectional view of a liquid applicator device 5P of the prior art in a closed position. The liquid applicator device 5P is secured to the container 10P as shown and described in FIGS. 1-4. The liquid applicator device 5P comprises an applicator tip 20P cooperating with a dispensing mechanism 25P for dispensing the applicator liquid 8. The applicator tip 20P extending from an inner end 21P to an outer end 22P and has an outer diameter surface 23P.

The dispensing mechanism 25P comprises an inner subassembly 31P and an outer subassembly 32P. The inner subassembly 31P comprises a valve body 40P, a valve element 50P, a valve seal 60P, a spring 70P and a tubular seal 80P. The valve body 40P includes a hole 49P for enabling the applicator liquid 8 to enter the valve body 40P.

The outer subassembly 32P comprises a closure 90P having a passageway 94P defined by a sleeve 98P for slidably receiving the applicator tip 20P. The outer subassembly 32P seals with the container 10. The inner subassembly 31P is interconnected to the outer subassembly 32P in a snap locking engagement. A complete explanation of the liquid applicator device 5P of the prior art is set forth in U.S. Pat. No. 4,685,820 and U.S. Pat. No. 4,792,252 to Kremer et al.

Figure 6:
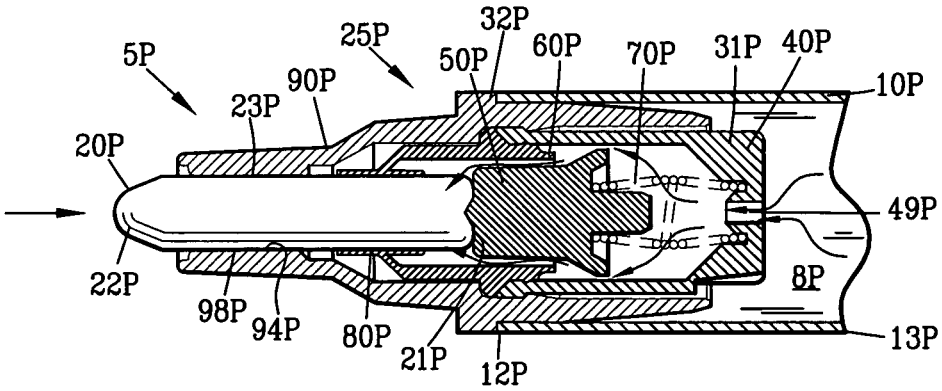
FIG. 6 is a view similar to FIG. 5 illustrating the prior art liquid applicator device in an open position.

FIG. 6 is an enlarged sectional view similar to FIG. 5 illustrating the liquid applicator device 5P of the prior art in an open position. A depression of the applicator tip 20P against a surface (not shown) will compress the spring 70P and move the valve element 50P inwardly from the valve seal 60P to move the dispensing mechanism 25P in the open condition. The displacement of the valve element 50P enables the passage of applicator liquid 8 from the container 10 to the inner end 21P of the applicator tip 20P.

Figure 7:
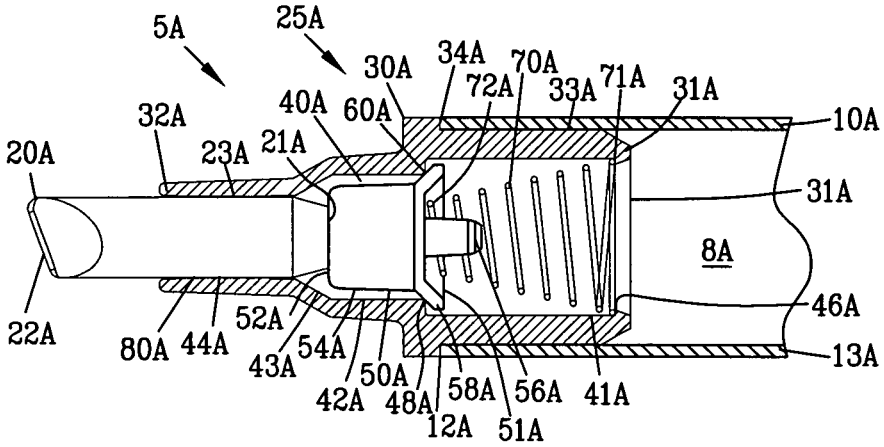
FIG. 7 is an enlarged view of a portion of FIG. 2 illustrating a first embodiment of the liquid applicator device of the present invention in a closed position.

FIG. 7 is an enlarged view of a portion of FIG. 2 illustrating a first embodiment of the liquid applicator device 5A of the present invention shown in FIGS. 1-4. The liquid applicator device 5A is shown in a closed position. The liquid applicator device 5A comprises an applicator tip 20A cooperating with a dispensing mechanism 25A for dispensing the applicator liquid 8. The applicator tip 20A extending from an inner end 21A to an outer end 22A and has an outer diameter surface 23A.

The dispensing mechanism 25A comprises a closure 30A extending between a closure inner end 31A and a closure outer end 32A. The closure 30A is joined to the container 10A by a press fit engagement. An outer diameter 33A of the closure 30A is tapered for insertion into the open-end 12A of the container 10A. The outer diameter 33A of the closure 30A is provided with an outer shoulder 34A for engaging with the open-end 12A of the container 10A to properly locate the closure 30A within the open-end 12A of the container 10A.

The closure 30A includes a passageway 40A extending between the closure inner end 31A and the closure outer end 32A. The passageway 40A comprises an inner passageway 41A, an intermediate passageway 42A, a tapered passageway 43A and an outer passageway 44A.

Figure 9:
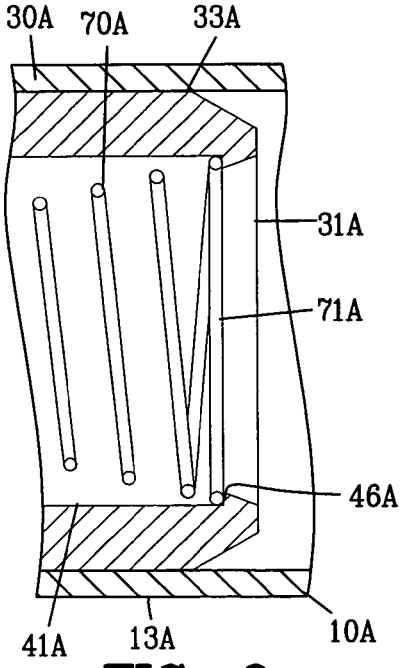
FIG. 9 is a magnified view of a portion of FIG. 7 illustrating a spring retaining lip.

FIG. 9 is a magnified view of a portion of FIG. 7 illustrating a retaining lip 46A. The retaining lip 46A extends inwardly from the inner end 31A of the closure 30A. Preferably, the retaining lip 46A is integrally formed with the closure 30A as a one-piece unit.

Figure 10:
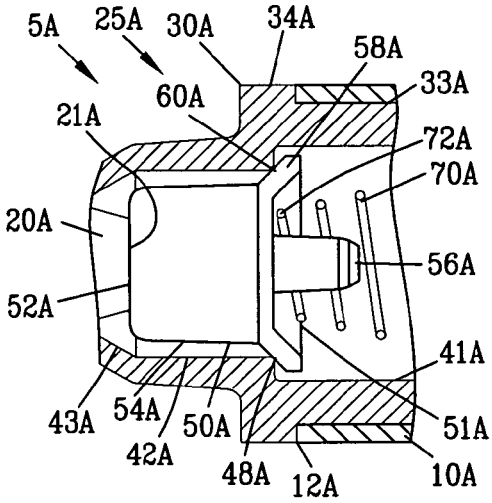
FIG. 10 is a magnified view of a portion of FIG. 7 illustrating a valve of the liquid applicator device in a closed position.

FIG. 10 is a magnified view of a portion of FIG. 7. An inner shoulder 48A is defined between the inner passageway 41A and the intermediate passageway 42A of the passageway 40A. The inner shoulder 48A is integrally formed with the closure 30A as a one-piece unit.

The liquid applicator device 5A comprises a valve element 50A extending between an inner end 51A and an outer end 52A. The valve element 50A defines a circumferential sidewall 54A. A valve element projection 56A extends from the valve element inner end 51A of the valve element 50A. The sidewall 54A of the valve element 50A supports flared peripheral shoulder 58A.

The outside diameter of the flared peripheral shoulder 58A is less than the diameter of the inner passageway 41A of the closure 30A for enabling the valve element 50A to move within the inner passageway 41A of the closure 40A. Similarly, the outside diameter of the sidewall 54A is less than the diameter of the intermediate passageway 42A of the closure 30A for enabling the valve element 50A to move within the intermediate passageway 42A of the closure 40A.

The outside diameter of the flared peripheral shoulder 58A is greater than the diameter of the intermediate passageway 42A of the closure 40A for providing an engagement with the inner shoulder 48A defined between the inner passageway 41A and the intermediate passageway 42A of the passageway 40A. The inner shoulder 48A defines a valve seal 60A for forming a liquid tight seal with the valve element 50A.

A spring 70A extends between a first end 71A in a second spring end 72A. The first end 71A of the spring 70A is retained within the closure 40A by the retaining lip 46A. The valve element projection 56A of the valve element 50A retains the second end 72A of the spring 70A. The spring 70A biases the dispensing mechanism 25A in a closed position as shown in FIG. 7. The flared peripheral shoulder 58A of the valve element 50A is biased into engagement with the valve seal 60A by the spring 70A to prevent the passage of the applicator liquid 8A. In this embodiment, the spring 70A is formed of stainless steel or other similar material to preclude or minimize chemical reaction with the applicator liquid 8A.

The applicator tip 20A extends between the inner end 21A and the outer end 22A and defines a cylindrical diameter 23A between the inner end 21A and the outer end 22A. The inner end 21A of the applicator tip 20A is in direct engagement with the valve element outer end 52P of the valve element 50A. The cylindrical diameter 23A of the applicator tip 20A forms a sliding seal 80A with the outer region 44A of the passageway 40A of the closure 30A.

Figure 8:
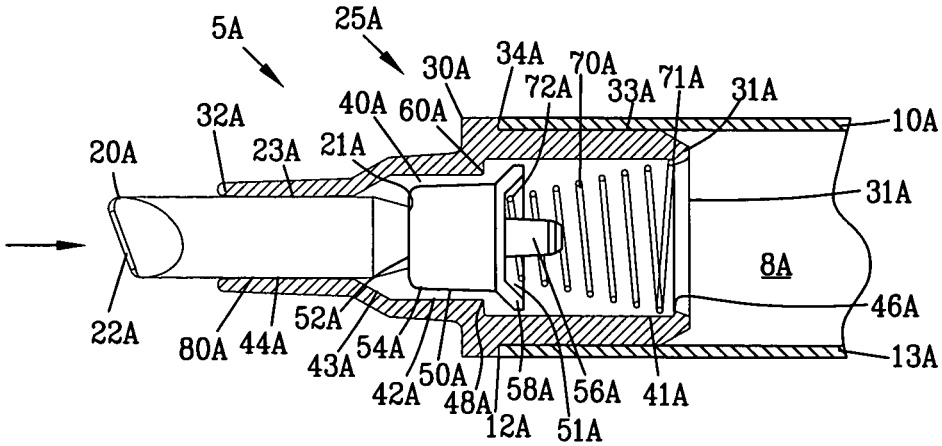
FIG. 8 is a view similar to FIG. 7 illustrating the liquid applicator device in an open position.
Figure 11:
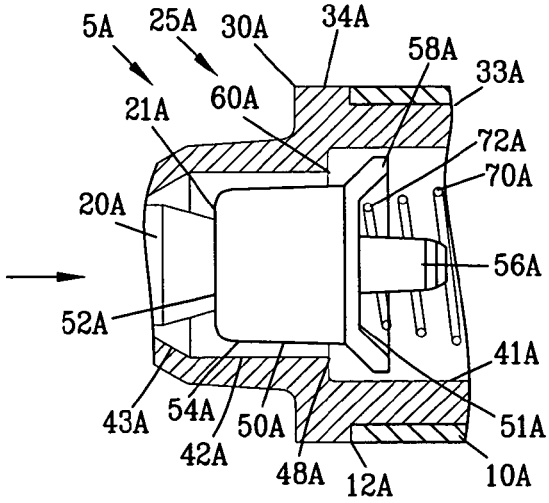
FIG. 11 is a view similar to FIG. 10 illustrating the valve of the liquid applicator device in an open position.

FIGS. 8 and 11 are views similar to FIGS. 7 and 10 illustrating the liquid applicator device 5A in an open position. A depression of the applicator tip 20A against a surface (not shown) will compress the spring 70A and move the valve element 50A inwardly from the inner shoulder 48A to move the dispensing mechanism 25A in the open position. The flared peripheral shoulder 58A of the valve element 50A is separated from the inner shoulder 48A to terminate the valve seal 60A for enabling the passage of the applicator liquid 8A from the container 10A to contact the inner end 21A of the applicator tip 20A. The applicator liquid 8A moves from the inner end 21A to the outer end 22A of the applicator tip 20A by capillary action. The applicator liquid 8A at the outer end 22A of the applicator tip 20A may be transferred to a surface (not shown) by marking, dabbing or a brushing action.

Figure 12:
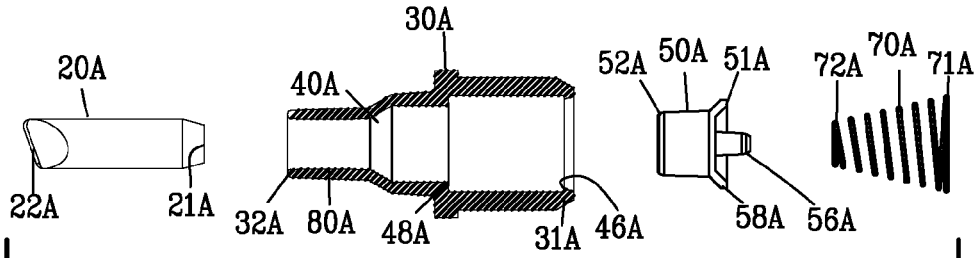
FIG. 12 is an exploded view of the liquid applicator device of FIGS. 7-11.

FIG. 12 is an exploded view of the liquid applicator device 5A of FIGS. 7-11. The component parts including the applicator tip 20A, the closure 30A, the valve element 50A and the spring 70A are shown in an aligned position.

Figure 13:
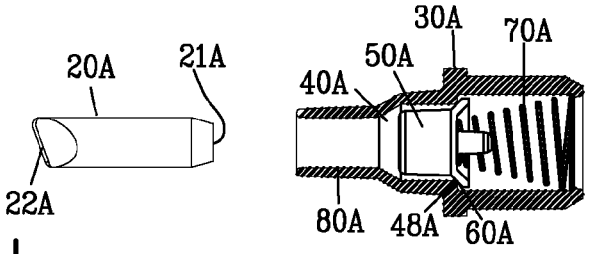
FIG. 13 is a first step in the process of assembling the liquid applicator device of FIGS. 7-11 illustrating the insertion of a valve and a spring into a closure of the liquid applicator device.

FIG. 13 is a first step in the process of assembling the liquid applicator device 5A of FIGS. 7-11 illustrating the insertion of a valve element 50A and the spring 70A into the closure 30A of the liquid applicator device 5A. The valve element 50A and the spring 70A are inserted into the inner end 31A of the closure 30A until the first end 71A of the spring 70A is retained by the retaining lip 46A. The spring 70A maintains the valve element 50A into sealing engagement with the inner shoulder 48A to form the valve seal 60A.

Figure 14:
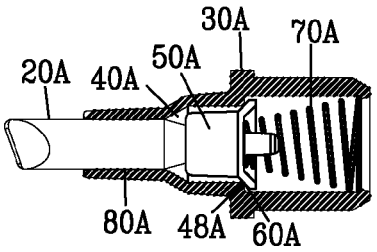
FIG. 14 is a second step in the process of assembling the liquid applicator device of FIGS. 7-11 illustrating the insertion of an applicator tip into a closure of the liquid applicator device.

FIG. 14 is a second step in the process of assembling the liquid applicator device 5A of FIGS. 7-11 illustrating the insertion of the applicator tip 20A into the closure 30A. The first end 21A of the applicator tip 20A is inserted into the outer passageway 44A of the closure 30A until the first end 21A of the applicator tip 20A engages with the outer end 52A of the valve element 50A. The applicator tip 20 is retained within the outer passageway 44A of the closure 30A by the frictional forces of the sliding seal 80A between the cylindrical diameter 23 of the applicator tip 20A and the outer region 44A of the passageway 40A of the closure 30A.

Figure 15:
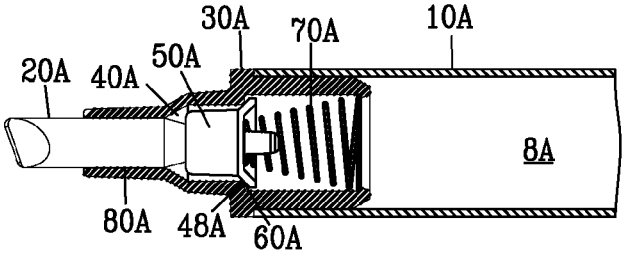
FIG. 15 is a third step in the process of assembling the liquid applicator device of FIGS. 7-11 illustrating the affixing of the liquid applicator device to a liquid container.

FIG. 15 is a third step in the process of assembling the liquid applicator device 5A of FIGS. 7-11 illustrating the affixing of the liquid applicator device 5A to the liquid container 10A. The tapered outer diameter 33A of the closure 30A is inserted into the open-end 12A of the container 10A to join the closure 30A to the container 10A by a press fit engagement. The outer shoulder 34A engages with the open-end 12A of the container 10A to properly locate the closure 30A within the open-end 12A of the container 10A. It should be understood by those skilled in the art that the container 10A may be joined to the closure 30A by various other means such as threads, adhesives, sonic welding, heat welding and the like.

Figure 16:
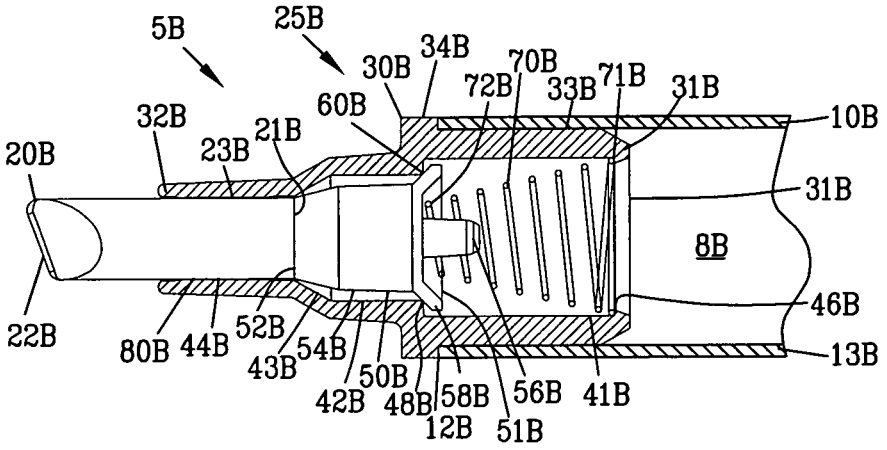
FIG. 16 is a view similar to FIG. 7 illustrating a second embodiment of the liquid applicator device of the present invention in a closed position.
Figure 17:
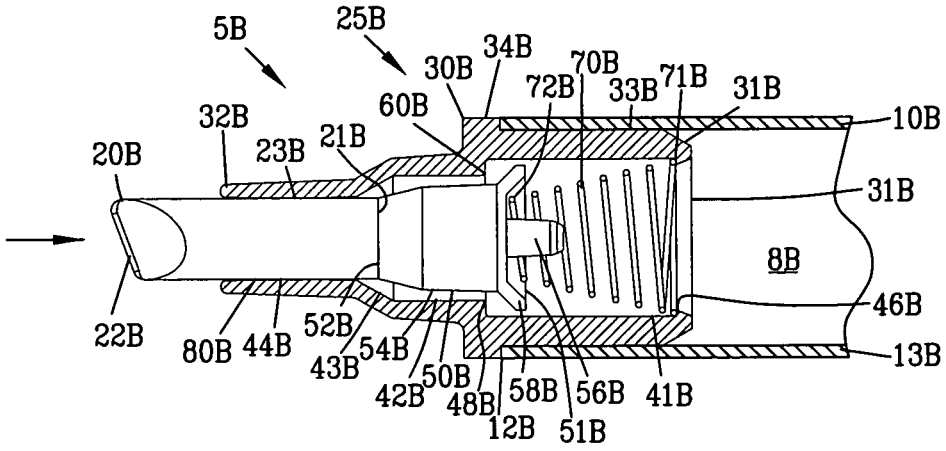
FIG. 17 is a view similar to FIG. 16 illustrating the liquid applicator device in an open position.

FIGS. 16 and 17 are side sectional view illustrating the second embodiment of a liquid applicator device 5B incorporating the present invention in a closed and an open position respectively. Similar parts are labeled with similar reference numerals followed by the alphabetical character B. In this example, the applicator tip 20B is integrally formed with the valve element 50B as a one-piece unit. The applicator tip 20B and the valve element 50B are integrally formed from a material which is capable of sealing with the valve seal 60B while able to transfer the applicator liquid 8B from the first end 21B to the second end of the applicator tip 20B.

Figure 18:
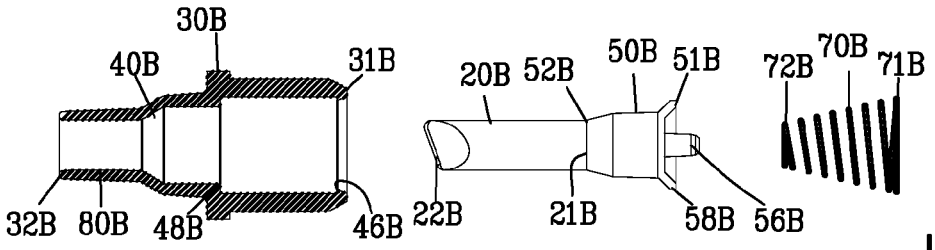
FIG. 18 is an exploded view of the liquid applicator device of FIGS. 16-17.

FIG. 18 is an exploded view of the liquid applicator device 5B of FIGS. 16-17. The component parts including the closure 30B, the unitary applicator tip 20B and valve element 50B and the spring 70B are shown in an aligned position.

Figure 19:
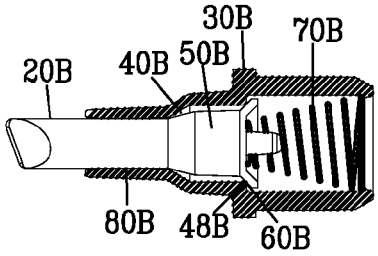
FIG. 19 is a first step in the process of assembling the liquid applicator device of FIGS. 16-17 illustrating the insertion of an applicator tip and a valve and a spring into a closure of the liquid applicator device.

FIG. 19 is a first step in the process of assembling the liquid applicator device 5B of FIGS. 16-17 illustrating the insertion of the unitary applicator tip 20B and valve element 50B and the spring 70B into the inner end 31B of the closure 30B. The valve element 50B and the spring 70B are inserted into a closure 30B until the first end 71B of the spring 70B is retained by the retaining lip 46B. The spring 70B maintains the valve element 50B into sealing engagement with the inner shoulder 48B to form the valve seal 60B.

Figure 20:
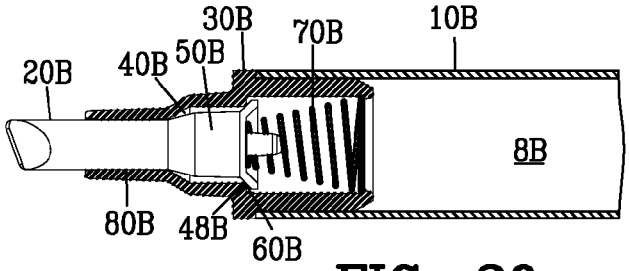
FIG. 20 is a second step in the process of assembling the liquid applicator device of FIGS. 16-17 illustrating the affixing of the liquid applicator device to a liquid container.

The second embodiment of the liquid is applicator device 5B has the advantage that the applicator tip 20B may not be removed from the outer end 31B of the closure 30B. The enlarged dimension of the valve element 50B prevents the applicator tip 20B from being removed from the outer end 31B of the closure 30B because the applicator tip 20B is unitary with the valve element 50B, FIG. 20 is a second step in the process of assembling the liquid applicator device 5B of FIGS. 16-17 illustrating the affixing of the liquid applicator device 5B to the liquid container 10B. The tapered outer diameter 33B of the closure 30B is inserted into the open-end 12B of the container 10B to join the closure 30B to the container 10B.

Figure 21:
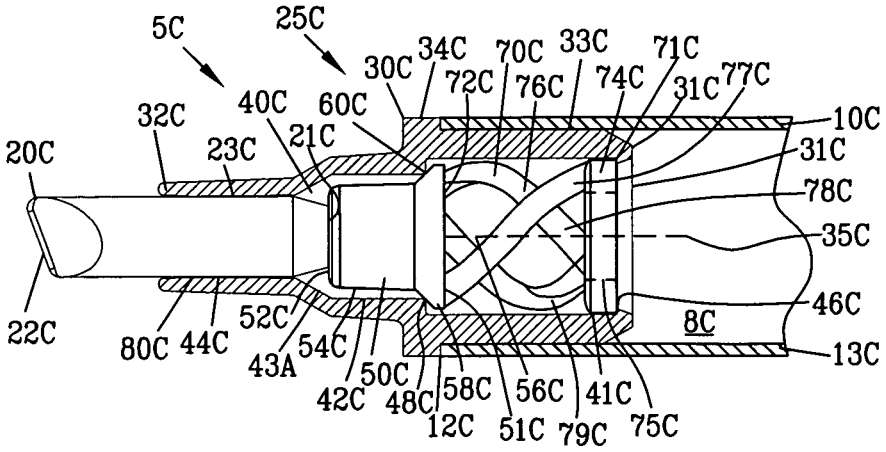
FIG. 21 is a view similar to FIG. 7 illustrating a third embodiment of the liquid applicator device of the present invention in a closed position.

FIG. 21 is a side sectional view illustrating the third embodiment of a liquid applicator device 5C incorporating the present invention in a close position. Similar parts are labeled with similar reference numerals followed by the alphabetical character C. In this example, the spring 70C is integrally formed with the valve element 50C as a one-piece unit. The spring 70C and the valve element 50C are integrally formed from a material that is resiliently deformable for forming the valve seal 60C between the inner shoulder 48B of the closure 30C and the valve element 50C. Preferably, the spring 70C and the valve element 50C are integrally formed from a polymeric material.

The spring 70C comprises an annular base 74 having a central aperture 75C. A plurality of spring elements 76C extend between the annular base 74 and the valve element inner end 51C of the valve element 50C. In this example, three spring elements 77C-79C are distributed uniformly about an axis of symmetry 35C of the closure 30C. Each of the spring elements 77C-79C extends arcuately between the annular base 74C and the valve element 50C. In this example, each of the spring elements 77C-79C extends as a portion of a helix between the annular base 74C and the valve element 50C. The combined valve element 50C and spring 70C are retained within the closure 30C through the engagement of the annular base 74C with the retaining lip 46C of the closure 30C.

Figure 22:
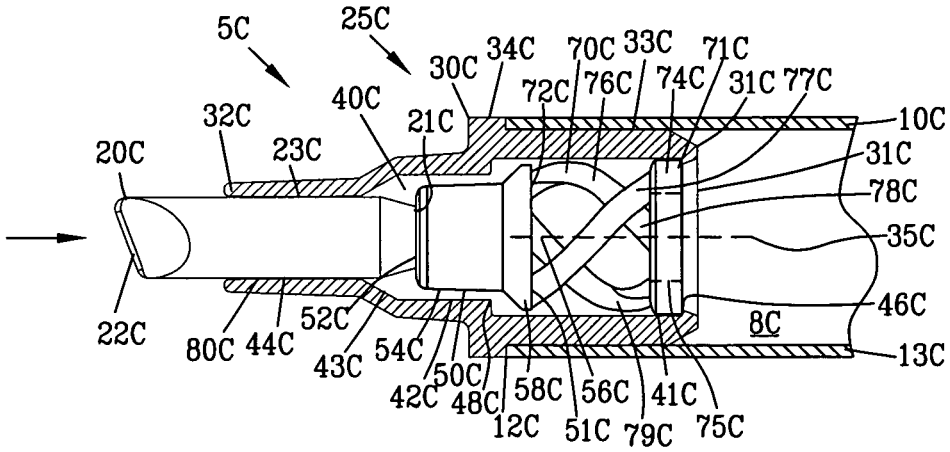
FIG. 22 is a view similar to FIG. 21 illustrating the liquid applicator device in an open position.

FIG. 22 is a side sectional view views similar to FIG. 21 illustrating the liquid applicator device 5C in an open position. A depression of the applicator tip 20C against a surface (not shown) will deform the three spring elements 77C-79C and move the valve element 50C inwardly from the inner shoulder 48C to open the valve seal 60C for enabling the passage of the applicator liquid 8C from the container 10C to contact the inner end 21C of the applicator tip 20C. After the depression of the applicator tip 20C against a surface (not shown), the resiliency of three spring elements 77C-79C and move the valve element 50C into engagement with the inner shoulder 48C to restore the valve seal 60C as shown in FIG. 21.

Figure 23:
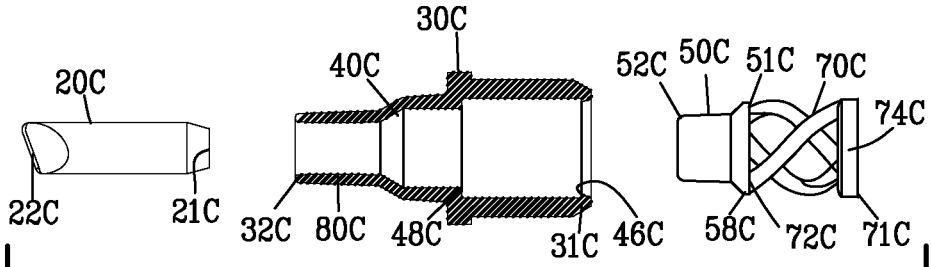
FIG. 23 is an exploded view of the liquid applicator device of FIGS. 21-22.

FIG. 23 is an exploded view of the liquid applicator device 5C of FIGS. 21-22. The component parts including the applicator tip 20C, the closure 30C and the combined unitary valve element 50C and spring 70C are shown in an aligned position.

Figure 24:
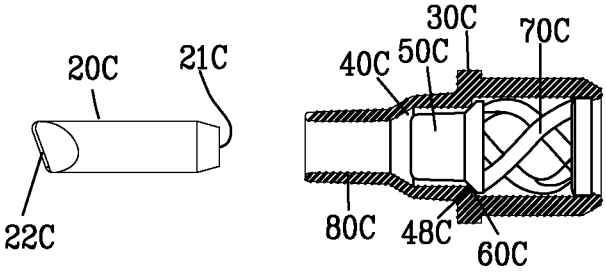
FIG. 24 is a first step in the process of assembling the liquid applicator device of FIGS. 16-17 illustrating the insertion of a valve and a spring into a closure of the liquid applicator device.

FIG. 24 is a first step in the process of assembling the liquid applicator device 5C of FIGS. 21-22 illustrating the insertion of the combined valve element 50C and unitary spring 70C into the closure 30C. The combined valve element 50C and spring 70C are inserted into the inner end 31C of the closure 30C until the annular base 74 of the spring 70C is retained by the retaining lip 46C. The spring 70C maintains the valve element 50C into sealing engagement with the inner shoulder 48C to maintain the valve seal 60C.

Figure 25:
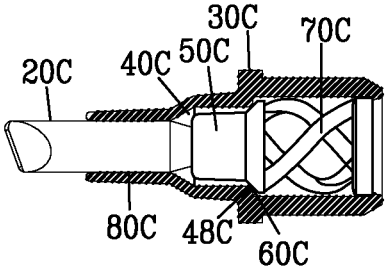
FIG. 25 is a second step in the process of assembling the liquid applicator device of FIGS. 21-22 illustrating the insertion of an applicator tip into a closure of the liquid applicator device.

FIG. 25 is a second step in the process of assembling the liquid applicator device 5C of FIGS. 21-22 illustrating the insertion of an applicator tip 20C into the closure 30C of the liquid applicator device 5C. The first end 21C of the applicator tip 20C is inserted into the outer passageway 44C of the closure 30C until the first end 21C of the applicator tip 20C engages with the outer end 52C of the valve element 50C. The applicator tip 20C is retained within the outer passageway 44C of the closure 30C by the frictional forces as previously described.

Figure 26:
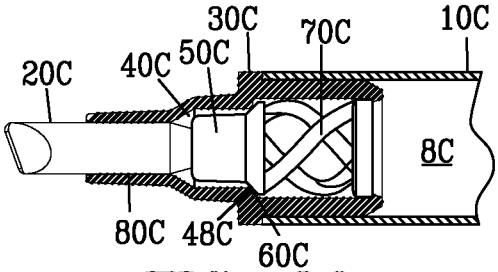
FIG. 26 is a third step in the process of assembling the liquid applicator device of FIGS. 21-22 illustrating the affixing of the liquid applicator device to a liquid container.

FIG. 26 is a third step in the process of assembling the liquid applicator device 5C of FIGS. 21-22 illustrating the affixing of the liquid applicator device 5C to the liquid container 10C. The tapered outer diameter 33C of the closure 30C is inserted into the open-end 12C of the container 10C to join the closure 30C to the container 10C.

Figure 27:
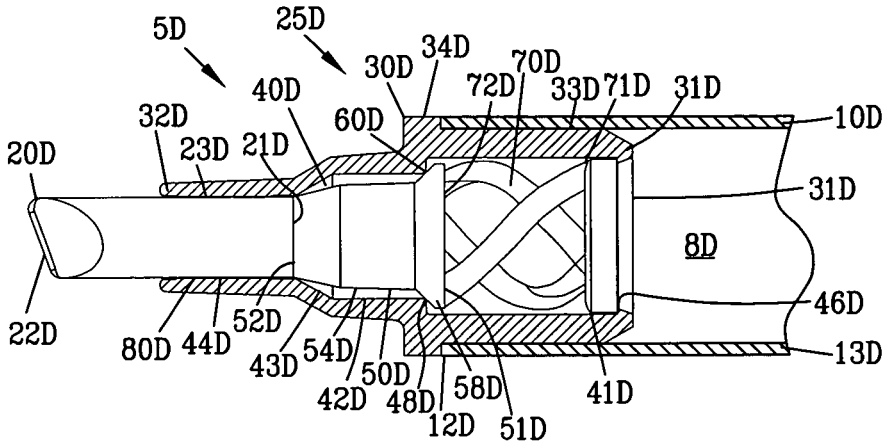
FIG. 27 is a view similar to FIG. 7 illustrating a fourth embodiment of the liquid applicator device of the present invention in a closed position.
Figure 28:
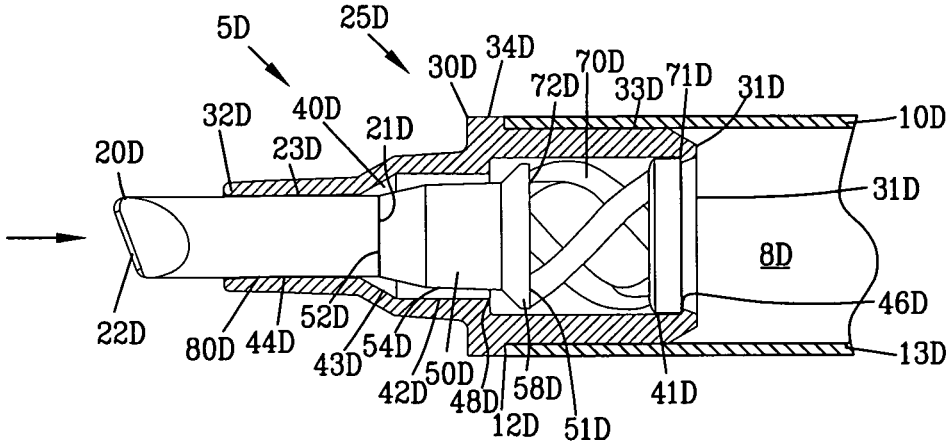
FIG. 28 is a view similar to FIG. 27 illustrating the liquid applicator device in an open position.

FIGS. 27 and 28 are side sectional views illustrating the fourth embodiment of a liquid applicator device 5D incorporating the present invention in a closed and an open position respectively. Similar parts are labeled with similar reference numerals followed by the alphabetical character D. In this example, the applicator tip 20D is integrally formed with the valve element 50D and the spring 70D as a one-piece unit. The applicator tip 20D and the valve element 50D and the spring 70D are integrally formed from a material which has sufficient resiliency to provide a seal between the valve element 50D and the valve seal 60D while able to transfer the applicator liquid 8D from the first end 21D to the second end of the applicator tip 20D. The spring 70D is identical to the spring 70C of the third embodiment of the liquid applicator device 5C shown in FIGS. 21-26.

Figure 29:
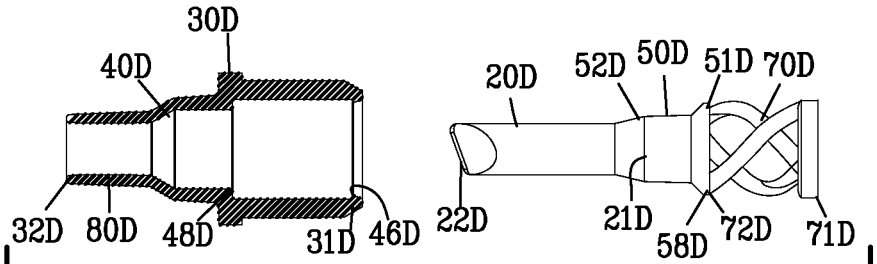
FIG. 29 is an exploded view of the liquid applicator device of FIGS. 27-28.

FIG. 29 is an exploded view of the liquid applicator device 5D of FIGS. 27-28. The component parts including the closure 30D, the unitary applicator tip 20D and the unitary valve element 50D and the unitary spring 70D are shown in an aligned position.

Figure 30:
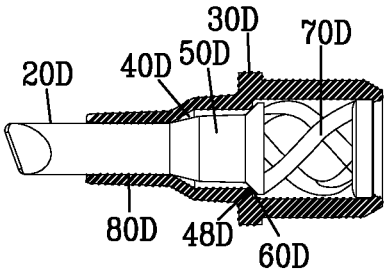
FIG. 30 is a first step in the process of assembling the liquid applicator device of FIGS. 27-28 illustrating the insertion of an applicator tip and a valve and a spring into a closure of the liquid applicator device.

FIG. 30 is a first step in the process of assembling the liquid applicator device 5D of FIGS. 16-17 illustrating the insertion of the combined unitary applicator tip 20D and the unitary valve element 50D and the unitary spring 70D into the inner end 31D of the closure 30D. The combined unitary applicator tip 20D and valve element 50D and spring 70D are inserted into a closure 30D until the first end 71D of the spring 70D is retained by the retaining lip 46D. The spring 70D maintains the valve element 50D into sealing engagement with the inner shoulder 48D to form the valve seal 60D.

The fourth embodiment of the liquid is applicator device 5D has the advantage that the applicator tip 20D may not be removed from the outer end 31D of the closure 30D. Since the applicator tip 20D is unitary with the valve element 50D, the enlarged dimension of the valve element 50D prevents the applicator tip 20D from being removed from the outer end 31D of the closure 30D.

Figure 31:
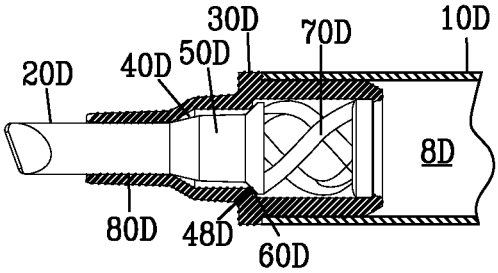
FIG. 31 is a second step in the process of assembling the liquid applicator device of FIGS. 27-28 illustrating the affixing of the liquid applicator device to a liquid container.

FIG. 31 is a second step in the process of assembling the liquid applicator device 5D of FIGS. 27-28 illustrating the affixing of the liquid applicator device 5D to the liquid container 10D. The tapered outer diameter 33D of the closure 30D is inserted into the open end 12D of the container 10D to join the closure 30D to the container 10D.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A liquid applicator device for dispensing an applicator liquid from an applicator liquid container; comprising;

a one piece closure for sealing with the applicator liquid container;

passageway defined by said one piece closure extending between an inner passageway, an intermediate passageway, a tapered passageway and an outer passageway decreasing in size from said inner passageway to said outer passageway;

a sealing surface defined by an intersection of said inner passageway and said intermediate passageway of said closure;

a valve element defining a cylindrical sidewall supporting a flared peripheral shoulder disposed within said closure with said cylindrical sidewall of said valve element slidably disposed within said intermediate passageway;

a spring retaining step unitary with said closure;

a spring located within said closure between said spring retaining step and said valve for biasing said flared peripheral shoulder of said valve into sealing engagement with said sealing surface of said closure for inhibiting the flow of the applicator liquid from the applicator liquid container;

a substantially rigid applicator tip slidably located in said outer passageway for forming a slidable seal with said closure; and said substantially rigid applicator tip engaging with said valve element for enabling a depression of said applicator tip to displace said flared peripheral shoulder of said valve element from said sealing surface of said closure to enable the flow of the applicator liquid from the applicator liquid container.

2. A liquid applicator device for dispensing an applicator liquid as set forth in claim 1, wherein said spring retaining step is an inwardly extending spring retaining step unitary with said closure.

3. A liquid applicator device for dispensing an applicator liquid as set forth in claim 1, wherein said spring is a metallic spring.

4. A liquid applicator device for dispensing an applicator liquid as set forth in claim 1, wherein said spring is a plastic spring.

5. A liquid applicator device for dispensing an applicator liquid as set forth in claim 1, wherein said spring is affixed to said valve.

6. A liquid applicator device for dispensing an applicator liquid as set forth in claim 1, wherein said spring is unitary with said valve.

7. A liquid applicator device for dispensing an applicator liquid as set forth in claim 1, wherein said applicator tip is affixed to said valve.

8. A liquid applicator device for dispensing an applicator liquid as set forth in claim 1, wherein said applicator tip is unitary with said valve.

9. A liquid applicator device for dispensing an applicator liquid as set forth in claim 1, wherein said spring is a plastic spring; and said applicator tip being affixed to said valve and affixed to said plastic spring.

10. A liquid applicator device for dispensing an applicator liquid as set forth in claim 1, wherein said spring is a plastic spring; and said applicator tip being unitary with said valve and unitary with said plastic spring.

11. A liquid applicator device for dispensing an applicator liquid from an applicator liquid container; comprising;

a one piece closure extending between a closure inner end and a closure outer end;

a mounting defined by said closure inner end of said closure for sealing with the applicator liquid container;

a passageway defined by said one piece closure extending between the closure inner end and the closure outer end;

said passageway comprising an inner passageway, an intermediate passageway, a tapered passageway and an outer passageway;

said inner passageway, said intermediate passageway, said tapered passageway and said outer passageway decreasing in size from said inner passageway to said outer passageway;

an inner shoulder located at an intersection of said inner passageway and said intermediate passageway for defining a sealing surface of said closure;

a valve element extending between a valve inner end and a valve outer end disposed within said closure;

said valve element defining a cylindrical sidewall supporting a flared peripheral shoulder;

said cylindrical sidewall of said valve element slidably disposed within said intermediate passageway;

a spring retaining step extending inwardly into said inner passageway from the inner end of said closure;

a spring located within said closure between said spring retaining step and said valve element for biasing said flared peripheral shoulder of said valve into sealing engagement with said sealing surface of said closure for inhibiting the flow of the applicator liquid from the applicator liquid container;

a substantially rigid applicator tip slidably located in said outer passageway for forming a slidable seal with said closure; and a first end of said substantially rigid applicator tip engaging said valve element for enabling a depression of a second end of said substantially rigid applicator tip to displace said valve from said sealing surface of said closure for enabling the flow of the applicator liquid from the applicator liquid container.

12. A liquid applicator device for dispensing an applicator liquid from an applicator liquid container; comprising;

a one piece closure extending between a closure inner end and a closure outer end;

a mounting defined by said closure inner end of said closure for sealing with the applicator liquid container;

a passageway defined by said one piece closure extending between the closure inner end and the closure outer end;

said passageway comprising an inner passageway, an intermediate passageway, a tapered passageway and an outer passageway;

said inner passageway, said intermediate passageway, said tapered passageway and said outer passageway decreasing in size from said inner passageway to said outer passageway;

an inner shoulder located at an intersection of said inner passageway and said intermediate passageway for defining a sealing surface of said closure;

a one piece valve element extending between a valve inner end and a valve outer end disposed within said closure;

said valve element defining a cylindrical sidewall supporting a flared peripheral shoulder;

said cylindrical sidewall of said valve element slidably disposed within said intermediate passageway;

a spring retaining step extending inwardly into said inner passageway from the inner end of said closure;

a one piece spring located within said closure between said spring retaining step and said valve element for biasing said flared peripheral shoulder of said valve into sealing engagement with said sealing surface of said closure for inhibiting the flow of the applicator liquid from the applicator liquid container;

a one piece substantially rigid applicator tip slidably located in said outer passageway for forming a slidable seal with said closure; and a first end of said substantially rigid applicator tip engaging said valve element for enabling a depression of a second end of said applicator tip to displace said valve from said sealing surface of said closure for enabling the flow of the applicator liquid from the applicator liquid container.

* * * * *